US005299620A

United States Patent [19]

Revankar et al.

[11] Patent Number: 5,299,620

[45] Date of Patent: Apr. 5, 1994

[54] METAL CASTING SURFACE MODIFICATION BY POWDER IMPREGNATION

[75] Inventors: Gopal S. Revankar, Moline; Daniel L. DeRoo, Colona, Ill.

[73] Assignee: Deere & Company, Moline, Ill.

[21] Appl. No.: 822,903

[22] Filed: Jan. 21, 1992

[51] Int. Cl.[5] ..... B22D 19/14

[52] U.S. Cl. ..... 164/97; 164/111; 164/112

[58] Field of Search ..... 164/91, 97, 98, 100, 164/106, 111, 112

[56] References Cited

U.S. PATENT DOCUMENTS

| | | | |
|---|---|---|---|
| 1,978,319 | 10/1934 | Mowery | 164/112 |
| 2,874,429 | 2/1959 | Emter et al. | 164/111 |
| 4,119,459 | 10/1978 | Ekemar et al. . | |
| 4,587,707 | 5/1986 | Nishida et al. | 164/97 |
| 4,646,811 | 3/1987 | Morishita et al. | 164/9 |
| 5,027,878 | 7/1991 | Revankar et al. . | |

FOREIGN PATENT DOCUMENTS

| | | | |
|---|---|---|---|
| 0297552 | 1/1989 | European Pat. Off. . | |
| 0470503 | 2/1992 | European Pat. Off. . | |
| 6025211 | 7/1976 | Japan | 164/97 |
| 0026565 | 8/1978 | Japan | 164/97 |
| 0192671 | 11/1983 | Japan | 164/97 |
| 0021306 | 2/1985 | Japan | 164/97 |
| 0199256 | 9/1987 | Japan | 164/97 |
| 63-184074 | 2/1990 | Japan . | |
| 1163977 | 6/1985 | U.S.S.R. | 164/97 |
| 2074912 | 11/1981 | United Kingdom . | |

OTHER PUBLICATIONS

"Application of Cast-On Ferrochrome-Based Hard Surfacings to Polystyrene Pattern Castings", Bureau of Mines Report of Investigations 8942, U.S. Dept. of Interior (1985), Hanson et al.

*Primary Examiner*—Paula A. Bradley
*Assistant Examiner*—Erik R. Puknys
*Attorney, Agent, or Firm*—Burns, Doane, Swecker & Mathis

[57] ABSTRACT

A method for impregnating a metal product with a hard wear-resistant surface layer comprises providing a wear-resistant layer in the form of a partially sintered sheet having at least one peg formed therein; attaching the wear-resistant layer to a mold surface; and casting a metal melt so as to produce a metal product having a wear-resistant material surface layer. Preferably the mold surface is a sand core and the sheet has a hexagonal pattern molded therein so as to form a plurality of pegs.

12 Claims, 4 Drawing Sheets

METAL CASTING SURFACE MODIFICATION BY POWDER IMPREGNATION

BACKGROUND OF THE INVENTION

The present invention relates to a process for the impregnation of a metal product with a surface comprising a hard wear-resistant material.

A wide variety of techniques are known for the impregnation of metals, e.g., iron, with a hard wear-resistant surface. Such techniques include flame spray coating and plasma spray coating. However, each of these spray coating techniques suffer from problems associated with the spalling of surface layers during the coating process and during service as well as the particularly large expense associated with the use of this technique.

Cast-in-carbides are also known in which carbide particulates are placed in a mold and molten iron is then cast. See, for example, the discussion within U.S. Pat. No. 4,119,459 to Eckmar et al. It is difficult, however, with such castings to accurately maintain the carbide particles in the desired location and in a regular distribution pattern.

In addition, certain cast-on hard surfacing techniques for use with polystyrene patterns are also known in the art. See, for example, the discussion in Hansen et al., "Application of Cast-On Ferrochrome-Based Hard Surfacing to Polystyrene Pattern Castings," Bureau of Mines Report of Investigations 8942, U.S. Department of the Interior, 1985.

However, this process suffers from problems associated with the low reliability of the bond formed between the wear-resistant layer, e.g., tungsten carbide, and the foam pattern. Because of this failure, the iron may not penetrate the layer before the iron solidifies and thus, instead of impregnating the iron, the carbide spalls off the product.

The inventors of the present invention have also been involved with other processes which attempt to more effectively impregnate the surface of a metal, e.g., iron, with carbides during the casting process. For example, attention is directed toward U.S. Pat. No. 5,027,878 which relates to the carbide impregnation of cast iron using evaporative pattern castings (EPC) as well as U.S. application Ser. Nos. 564,184 and 564,185 which relate to the impregnation of cast iron and aluminum alloy castings with carbides using sand cores.

However, despite their effectiveness, these methods also have certain drawbacks. For example, the EPC method may require the installation of special equipment in a conventional foundry. Furthermore, castings produced by this process can suffer from distortion due to the distortion of the plastic foam replicas. On the other hand, the above sand core methods of casting carbides involves the use of carbide spheres which can add to the cost of the process. The cost can be further increased where a flat wear-resistant surface is desired because in such cases surface layer equal in thickness to half the sphere diameter or more will need to be machined off.

Accordingly, the need still exists for a method of impregnating metal surfaces, and in particular iron surfaces with a hard wear-resistant material which is capable of overcoming the problems associated with known techniques.

SUMMARY OF THE INVENTION

In one aspect of the present invention, there is disclosed a method for the impregnation of a metal product with a hard wear-resistant material surface layer which involves the use of a partially sintered "slip" which preferably is shaped so as to provide a plurality of "pegs" made from the hard wear-resistant material. These "pegs" can provide for a better bond between the wear-resistant material and the metal than, e.g., when spheres of sintered carbides are used.

In particular, the present invention relates to a method for impregnating a metal product with a hard wear-resistant surface layer comprising:

(a) providing a wear-resistant layer in the form of a sintered sheet having at least one peg molded therein;

(b) attaching the wear-resistant layer to a mold surface; and (c) casting a metal melt so as to produce a metal product having a wear-resistant material surface layer.

In another aspect, the present invention relates to a product produced by this method.

DETAILED DESCRIPTION OF THE PREFERRED EMBODIMENTS

Figure 1A:
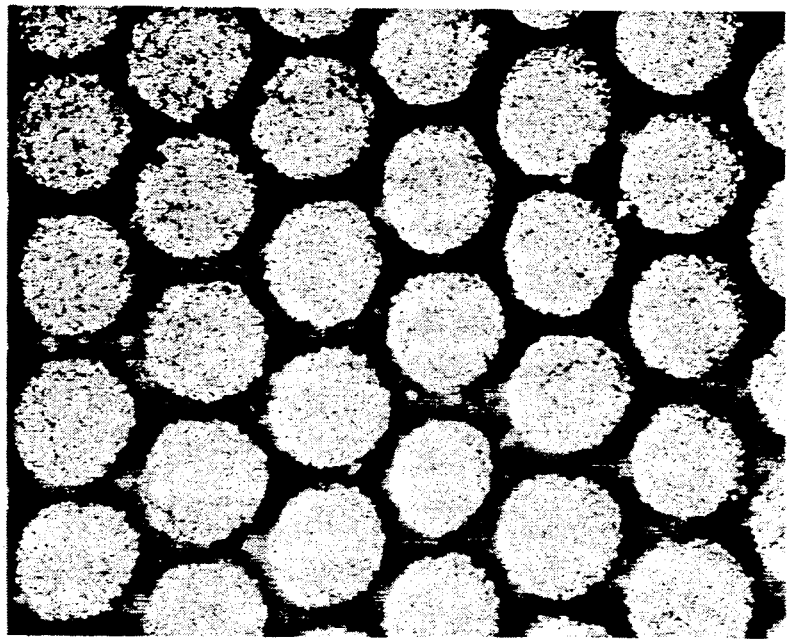
FIGS. 1(*a*) and (*b*) are optical photographs illustrating patterns of chromium carbide powder slip prior to sintering.

The present invention can be employed for casting virtually any type of metal which is known in the art, e.g., iron, aluminum, and the like, which will wet the carbide surface. However, cast iron, and particularly, ductile or grey iron are preferred for the most common types of wear-resistant carbides such as chromium carbide and the like.

In the present invention, an initial step involves the formation of a sheet comprising a wear-resistant material. As to the choice of the hard wear-resistant material, the present invention can effectively employ any of the hard phases, e.g., carbides such as tungsten carbide, chromium carbide, aluminides and the like which are recognized within the art. Furthermore, they can be replaced by powders of any metal, intermetallics or ceramics which are wetted by a matrix material such as iron or any other matrix material or alloy known within the art. For example, aluminum may be employed in order to enhance the surface wear-resistance of iron or nickel castings through the formation of aluminide intermetallic compounds. In addition, for aluminum castings, suitable materials such as nickel or iron may be employed.

In one preferred embodiment, where iron is to be cast, the wear-resistant material can also include a metallic binder, such as those of the Fe group, preferably Co for use with tungsten carbide, or Ni for chromium carbide, and the like. In particular, where ductile iron is employed as metal to be cast, particles comprising tungsten carbide with 14–17% by weight cobalt are preferred.

Although the size is not critical to the present invention, fine particles of the wear-resistant material are preferably employed, i.e., 140/325 or finer mesh size.

The sheet is formed by mixing a powder of the hard wear-resistant material with a suitable organic binder, e.g., a 10% polyvinyl alcohol (PVA) solution, and a suitable plasticizer, e.g., 2-ethylhexyl diphenyl phosphate, phosphate ester plasticizer (e.g., KRONITEX 3600 of FMC Corporation) or a mixture of such plasticizers so as to form a slip which has appropriate rheological characteristics such that it can be formed into a sheet. In this regard, any plasticizer and/or organic binder which can be effectively employed with a particular hard wear-resistant material is suitable for use in the invention.

An outer surface of the sheet is then patterned into a texture which allows for better impregnation of the iron. Any shape for the pattern which will provide at least one "peg" and, thus, effectively prevent the lateral movement of the sheet during casting can be employed. For example, a hexagonal or waffle texture can be patterned onto the surface of the sheet. See, for example, FIG. 1. Other suitable patterns include circular, elliptical and the like.

In fact, these "pegs" can have virtually any shape which provides the desired contour to reduce the distance of metal penetration through the "peg" mass during the casting process.

Moreover, this pattern can be formed by any suitable means, for example, by pressing a die with the required pattern onto the surface of the sheet while the sheet is still green and in a plastic state.

The sheet is then dried, e.g., in an oven at for example 100° C. so as to become a "rigid" solid. The sheet is then partially sintered under conditions suitable to provide a sheet with sufficient porosity which can withstand further handling and/or processing. For example, suitable conditions include, e.g., sintering in a vacuum at about 1200°–1250° C. for 300–360 minutes.

Figure 2:
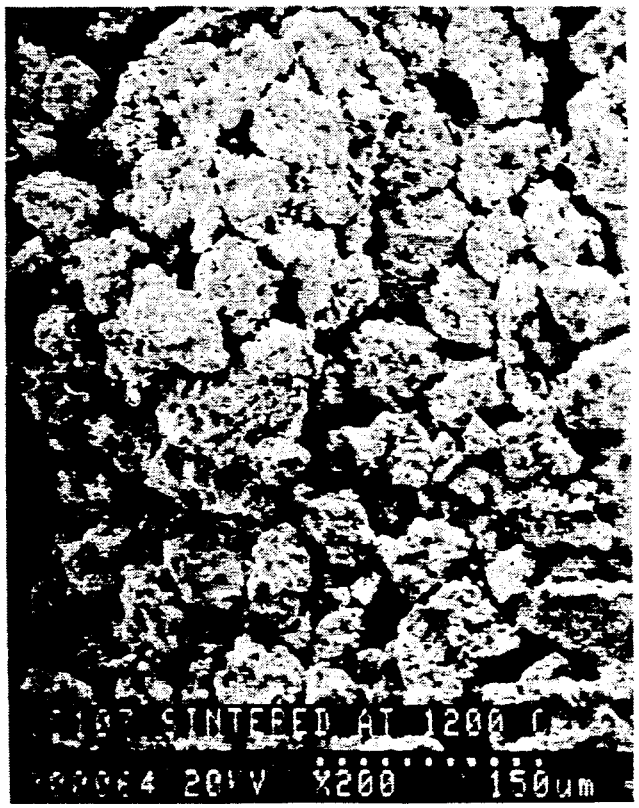
FIG. 2 is a SEM photograph of a presintered chromium carbide peg surface.

The above partially sintered sheet comprises a porous powder mass having partial densification. See for example, FIG. 2.

This partially sintered sheet can then be attached onto a suitable mold surface, e.g., a sand core so that the patterned surface making contact with the core, by means which are recognized within the art. For example, in one embodiment, a high temperature adhesive is employed and the layer is then heated in, e.g., an oven at 100° C., so as to drive moisture from, and thus cure, the adhesive.

By high temperature, it is meant that the adhesive has a melting point higher than the metal pouring temperature. Any suitable adhesive can be employed in the present invention with high temperature inorganic adhesives being preferred. For example, in that embodiment employing ductile iron as the metal, the binder preferably comprises a high temperature ceramic adhesive, AREMCO's Cermabond 569 which is proprietary high temperature binder that includes, for example, oxides of aluminum, silicon, and potassium as a colloidal suspension of water and which has a maximum use temperature of about 1650° C. (Cermabond is a trademark of Aremco Products, Inc.).

At this point, the liquid metal is cast around the hard wear-resistant material layer using any of the casting techniques traditionally employed in the art, e.g., gravity feed casting, squeeze casting, vacuum casting or the like. However, due to the ease of use, the gravity feed of metal is preferred.

Figure 3A:
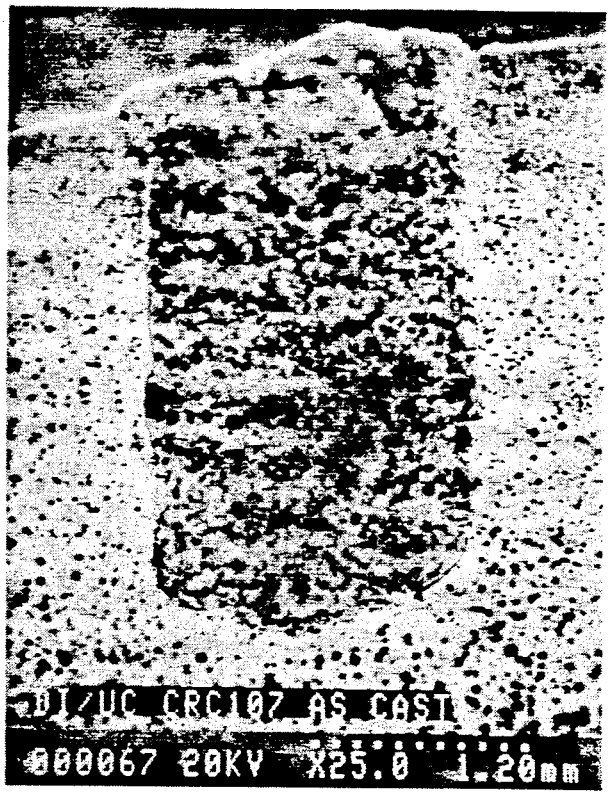
FIGS. 3(*a*) and (*b*) are photographs illustrating the microstructure of the ductile iron/chromium carbide composite surface.
Figure 3B:
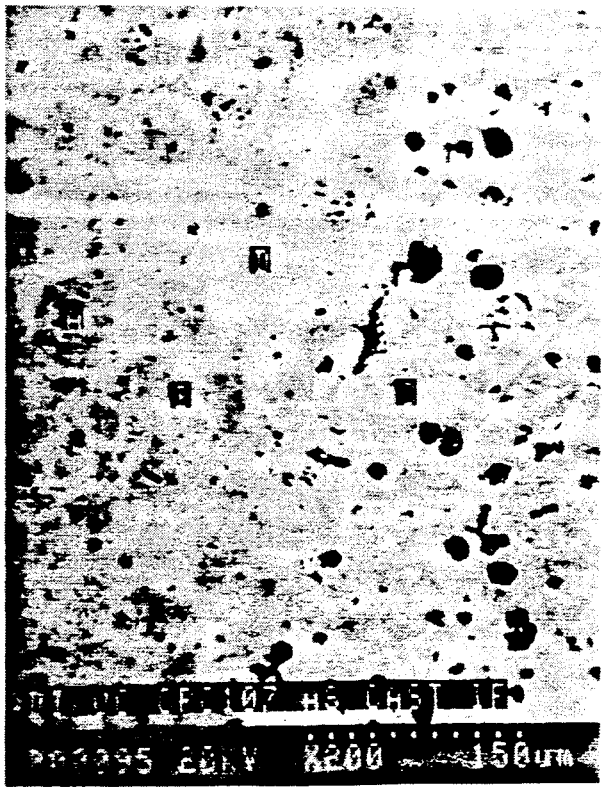

When suitable casting is performed, the wear-resistant material dissolves partially into the molten metal and reprecipitates on solidification. For example, chromium carbide dissolves partially into molten iron and then reprecipitates. The microstructure of such a composite is illustrated by FIG. 3 which also shows that the composite is bonded to the iron substrate in such a manner that it will not become easily detached therefrom.

Figure 4:
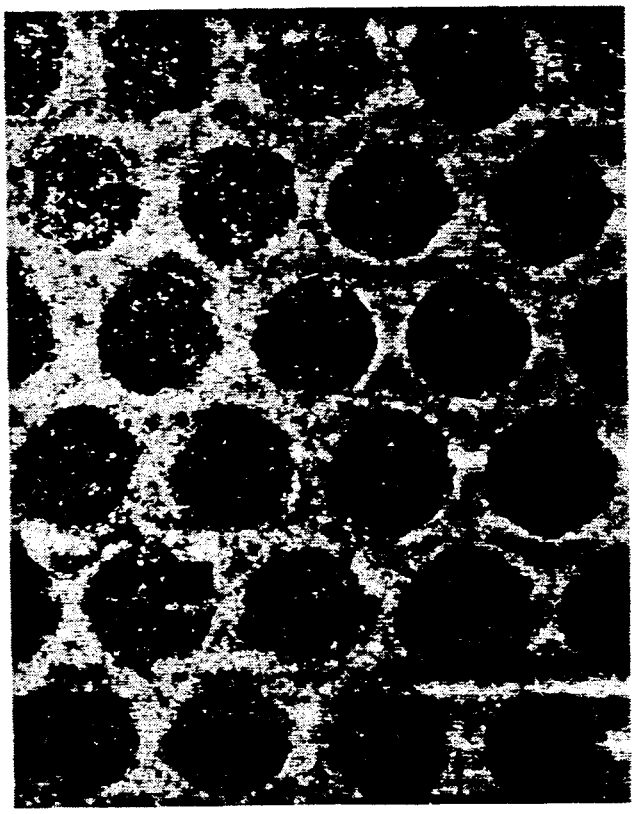
FIG. 4 is an optical photograph illustrating a ground and polished composite surface of a product produced according to the present invention.

The product can then be finished by any suitable techniques recognized within the art. FIG. 4 illustrates the ground surface of the composite in which the iron "network" around the composite "peg" is clearly visible.

The method according to the present invention can be used to produce metal products which have a wide variety of applications. Furthermore, as discussed above, this process may be applied to a variety of metals and alloys thereof.

In the specific case of cast iron, a metallurgical reaction also occurs which reaction further strengthens the iron-carbide bonding. This reaction can be facilitated by the pattern on the sheet.

The process of the present invention can also provide these products a greatly reduced cost when compared with prior art systems. In particular, the surface modification can be effectively accomplished during the casting process without requiring any subsequent brazing or welding and without requiring additional casting facilities such as that which can be associated with the EPC systems. In fact, this process can be easily adapted to exist in sandcasting foundry practices.

In order to further illustrate the present invention and the advantages associated therewith, the following specific example is given, it being understood that same is intended only as illustrative and in nowise limitative.

EXAMPLE

Figure 1B:
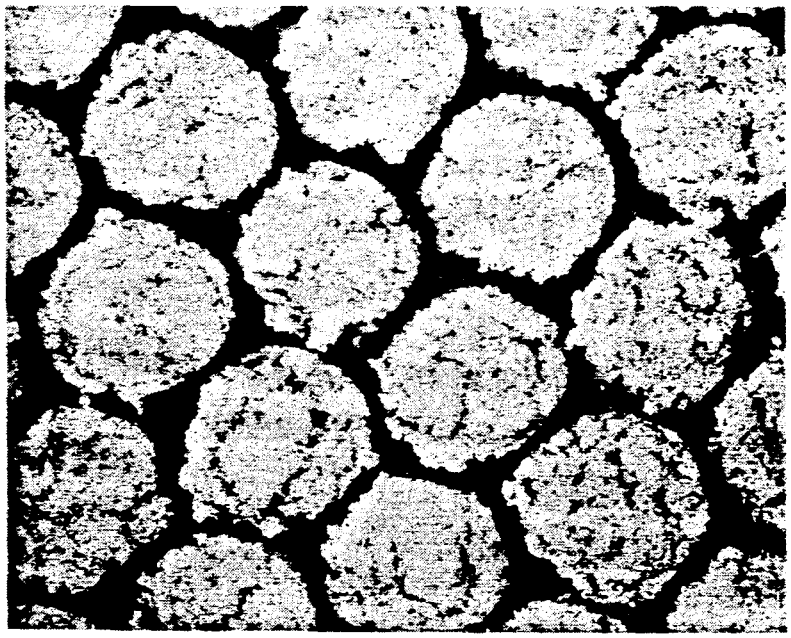

Fine chromium carbide powder (140/325 or finer) is mixed with a 10% aqueous polyvinyl alcohol solution and 2-ethylhexyl diphenyl phosphate or KRONITEX 3600 so as to form a slip with appropriate rheological characteristics such that it can be cast or rolled into a sheet. The sheet is then patterned is into "hexagonal" texture as illustrated in FIG. 1. The sheet is then dried in an oven in air at 100° C. and sintered in a vacuum at 1200°–1250° C. for 300–360 minutes.

The carbide sheet is then attached onto a sand core using Aremco's Cermabond 569 and the core/sheet is heated in an oven at 100° C. for 60–120 minutes to drive the moisture out from the binder and cure it. The cast iron is then cast around the sheet using conventional casting practice so that on the metal solidification, the carbide sheet is firmly attached to the casting surface.

While the invention has been described in terms of various preferred embodiments, the skilled artisan will appreciate the various modifications, substitutions, omissions, and changes which may be made without departing from the spirit thereof. Accordingly, it is intended that the scope of the present invention be defined solely by the scope of the following claims including equivalents thereof.

We claim:

1. A method for impregnating a metal product with a hard wear-resistant surface layer comprising:

(a) providing a partially dense wear-resistant layer comprising a partially sintered sheet having a pattern including a plurality of pegs formed on a surface thereof;

(b) attaching the wear-resistant layer to a mold surface; and (c) casting a metal melt so as to produce a metal product having a wear-resistant material surface layer.

2. The method according to claim 1 wherein the mold surface is a sand core and the pattern is a hexagonal pattern formed therein.

3. The method according to claim 2 wherein the layer is attached to the sand core using a high temperature adhesive.

4. The method according to claim 3 the high temperature adhesive is a high temperature ceramic adhesive.

5. The method according to claim 2 wherein the sheet is formed from a mixture of a powder of a wear-resistant material, an organic binder, and at least one plasticizer.

6. The method according to claim 5 wherein the mixture is cast into the sheet.

7. The method according to claim 2 wherein the metal is iron.

8. The method according to claim 7 wherein the iron is ductile iron.

9. The method according to claim 8 wherein the hard wear-resistant material is chromium carbide.

10. The method according of claim 2 wherein the metal is aluminum.

11. The method according to claim 10 wherein the hard wear-resistant material is nickel or iron aluminide intermetallic.

12. The method according to claim 2 wherein the wear-resistant material is a carbide or an aluminide and the sheet is cast from a mixture of a powder of the wear-resistant material, an organic binder and at least one plasticizer.

* * * * *